US008648750B2

(12) United States Patent
Chen et al.

(10) Patent No.: US 8,648,750 B2
(45) Date of Patent: Feb. 11, 2014

(54) ANTENNA WITH U-SHAPED PORTION AND EXTENDING SECTION

(75) Inventors: Huang-Chih Chen, Hsinchu (TW); Yung-Jinn Chen, Hsinchu (TW)

(73) Assignee: Wistron NeWeb Corp., Hsinchu (TW)

( * ) Notice: Subject to any disclaimer, the term of this patent is extended or adjusted under 35 U.S.C. 154(b) by 435 days.

(21) Appl. No.: 12/983,096

(22) Filed: Dec. 31, 2010

(65) Prior Publication Data

US 2011/0291893 A1 Dec. 1, 2011

(30) Foreign Application Priority Data

Jun. 1, 2010 (TW) ..... 99210355 U

(51) Int. Cl.
*H01Q 1/38* (2006.01)

(52) U.S. Cl.
USPC ..... 343/700 MS; 343/767

(58) Field of Classification Search
USPC ..... 343/700 MS, 767
See application file for complete search history.

(56) References Cited

U.S. PATENT DOCUMENTS 6,985,108 B2 * 1/2006 Mikkola et al. ..... 343/700 MS

* cited by examiner

*Primary Examiner* — Douglas W Owens
*Assistant Examiner* — Jae Kim

(57) ABSTRACT

An antenna for transmitting a wireless signal is provided. The antenna includes a ground element, a short element and a transmitting element. The short element is connected to the ground element. The transmitting element is connected to the short element, wherein the transmitting element is a claw shaped structure, and the transmitting element includes a first section, a second section and an extending section, wherein an end of the first section is connected to the short element, and the other end of the first section is connected to ends of the second section and the extending section, and a first groove is formed between the first section and the second section, and a second groove is formed between the first section and the extending section.

14 Claims, 9 Drawing Sheets

ANTENNA WITH U-SHAPED PORTION AND EXTENDING SECTION

CROSS REFERENCE TO RELATED APPLICATIONS

This application claims priority of Taiwan Patent Application No. 99210355, filed on Jun. 1, 2010, the entirety of which is incorporated by reference herein.

BACKGROUND OF THE INVENTION

1. Field of the Invention

The present invention relates to an antenna, and in particular relates to an antenna providing improved design freedom within a limited inner space of a portable electronic device.

2. Description of the Related Art

FIG. 1 shows a conventional planar inverted F antenna (PIFA) 1, which includes a ground element 10 and a transmitting element 20. Conventional planar inverted F antennas have huge dimensions, and are not capable for disposal in portable electronic devices. Additionally, conventional planar inverted F antennas are easily influenced by neighboring electronic elements (for example, metal elements, and amplifiers), thus, reducing bandwidth and transmission efficiency thereof.

BRIEF SUMMARY OF THE INVENTION

An antenna for transmitting a wireless signal is provided. The antenna includes a ground element, a short element and a transmitting element. The short element is connected to the ground element. The transmitting element is connected to the short element, wherein the transmitting element is a claw shaped structure, and the transmitting element includes a first section, a second section and an extending section, wherein an end of the first section is connected to the short element, and the other end of the first section is connected to ends of the second section and the extending section, and a first groove is formed between the first section and the second section, and a second groove is formed between the first section and the extending section.

The antenna of the embodiment of the invention provides improved bandwidth and transmission efficiency, even though a metal element is disposed below a transmitting element thereof.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
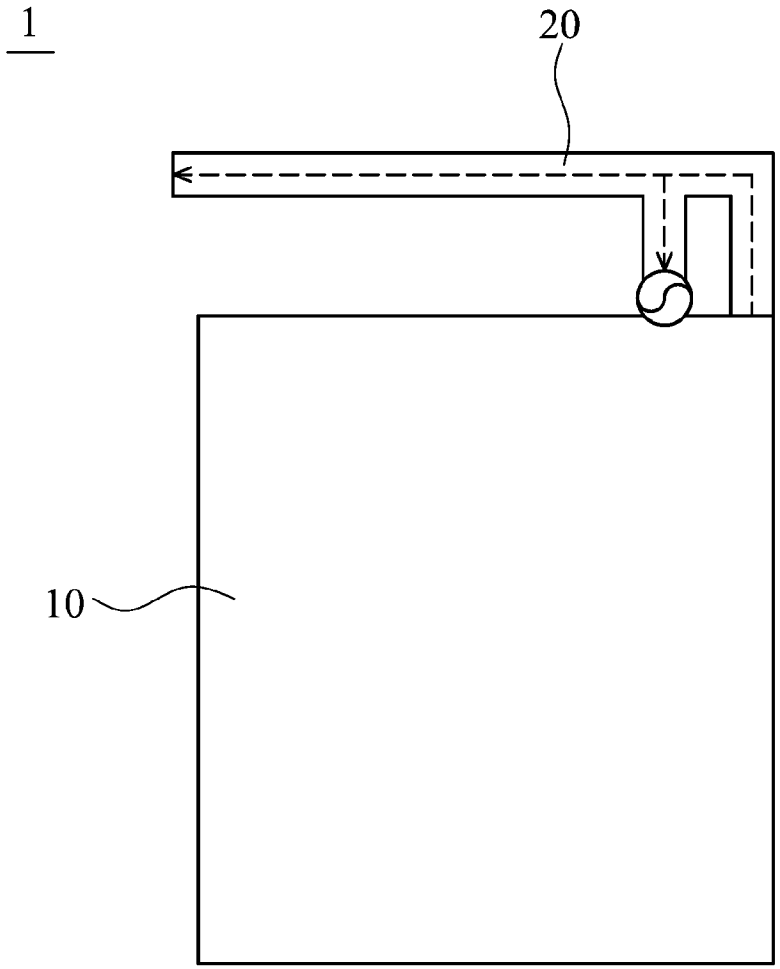
FIG. 1 ( PRIOR ART )
FIG. 1 shows a conventional planar inverted F antenna (PIFA)
Figure 2:
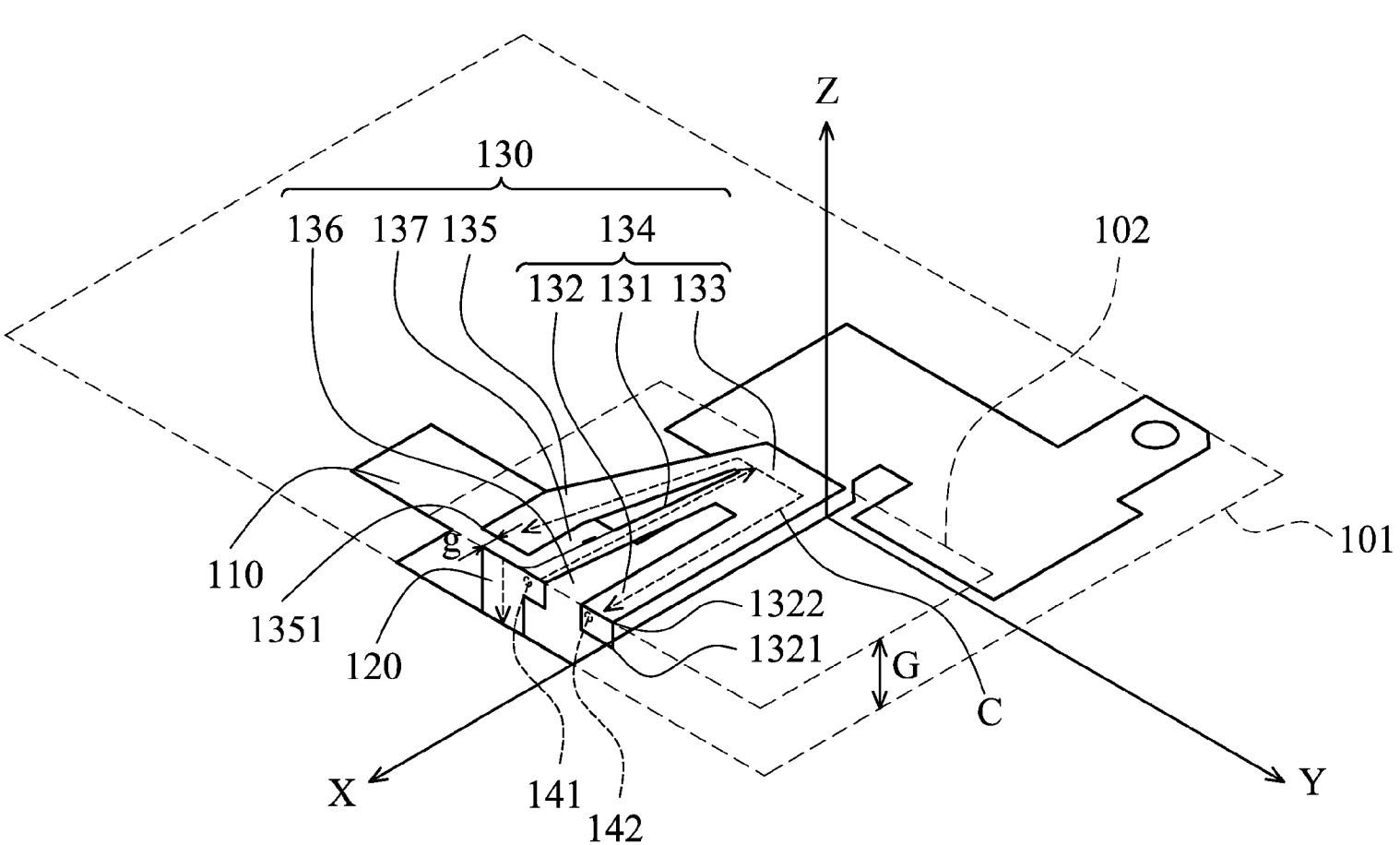
FIG. 2 shows an antenna of an embodiment of the invention.

FIG. 2 shows an antenna 100 of an embodiment of the invention for transmitting a wireless signal. The antenna 100 includes a ground element 110, a short element 120 and a transmitting element 130. The short element 120 is connected to the ground element 110. The transmitting element 130 is connected to the short element 120. The transmitting element 130 is a claw shaped structure, including a U shaped portion 134 and an extending section 135. The U shaped portion 134 includes a first section 131, a second section 132 and a third section 133. A first groove 136 is formed between the first section 131 and the second section 132. An end of the first section 131 is connected to the short element 120. The other end of the first section 131 is connected to the third section 133. An end of the second section 132 is connected to the third section 133. The other end of the second section 132 is a free end 1321. The second section 132 has a bending portion 1322 adjacent to the free end 1321. An end of the extending section 135 is connected to the third section 133. The other end of the extending section 135 is an extending free end 1351. A second groove 137 is formed between the first section 131 and the extending section 135.

The antenna further includes a ground point 141 and a feed point 142. The ground point 141 is located on the short element 120, and is adjacent to a connection point where the short element 120 is connected to the transmitting element 130. The feed point 142 is located on the second section 132 and adjacent to the free end 1321.

In the embodiment above, the U shaped portion 134 composes a loop antenna unit. The first section 131 and the extending section 135 compose an open stub unit. In the loop antenna unit, current C travels from the ground point 141, passing the first section 131, the third section 133 and the second section 132, along the first groove 136 to the feed point 142. In the open stub unit, the current C travels from the ground point 141, passing the first section 131 and the extending section 135, along the second groove 137 to the free end 1351. The shape and dimension of the first groove 136 controls the bandwidth and wavelength of the wireless signal. The shape and dimension of the second groove 137 controls the wavelength of the wireless signal.

In one embodiment, the extending section 135 extends toward the short element 120. A gap g is formed between the extending free end 1351 of the extending section 135 and the short element 120. The gap is between $0.03\lambda \sim 0.05\lambda$, and $\lambda$ is a wave length of a wireless signal with a central frequency. The extending free end 1351 of the extending section 135 couples to the short element 120 to further improve transmission of the antenna 100.

The ground element 110 is located on a first plane 101 and the transmitting element 130 is located on a second plane 102. The first plane 101 is parallel to the second plane 102. A distance G is formed between the first plane 101 and the second plane 102. The short element 120 is perpendicular to the ground element 110. In this embodiment, the transmitting element 130 couples the ground element 110, and the transmitting element 130 and the ground element 110 work as radiator to transmit the wireless signal. In one embodiment, the heights of the ground point 141 and the feed point 142 relative to the ground element 110 (on Z direction) can be modified to control the frequency of the wireless signal.

In one embodiment, the transmitting element 130 is disposed on a flexible printed circuit board. In another embodiment, the transmitting element 130 and the ground element 110 are disposed on a flexible printed circuit board.

Figure 3A:
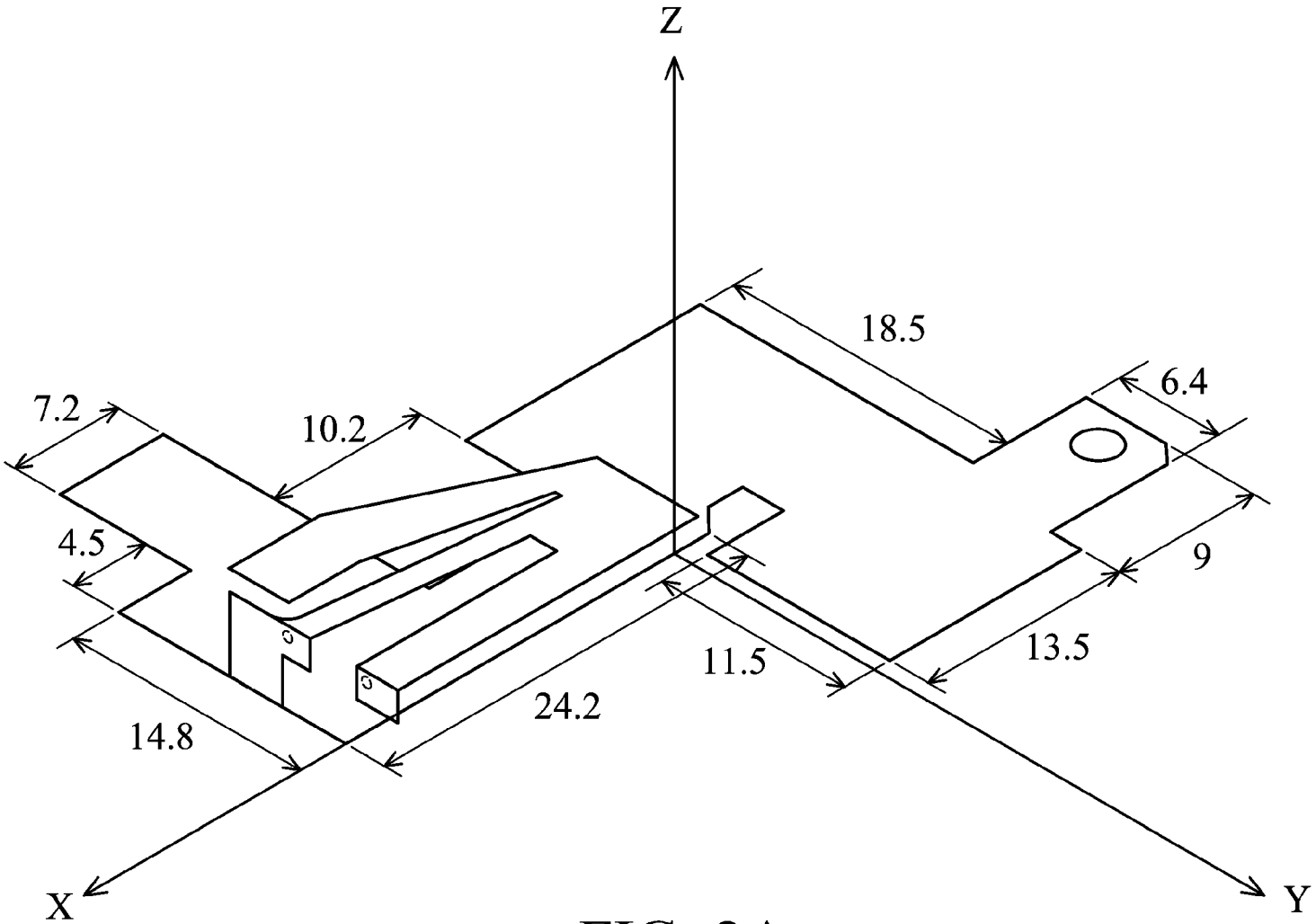
FIG. 3A shows reference dimensions of the antenna of an embodiment of the invention.
Figure 3B:
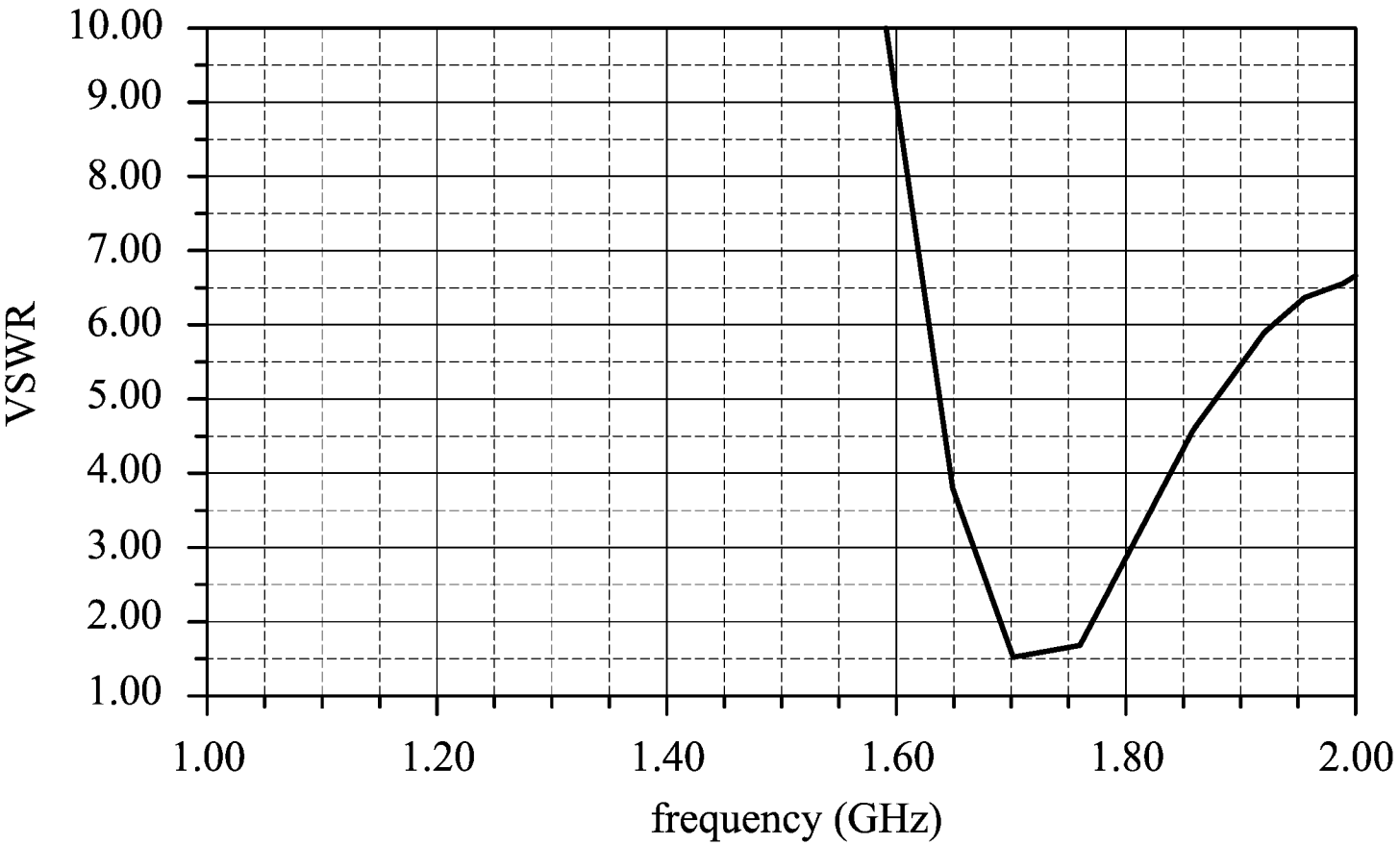
FIG. 3B shows Voltage Standing Wave Ratio (VSWR) of the antenna of FIG. 3A.
Figure 3C:
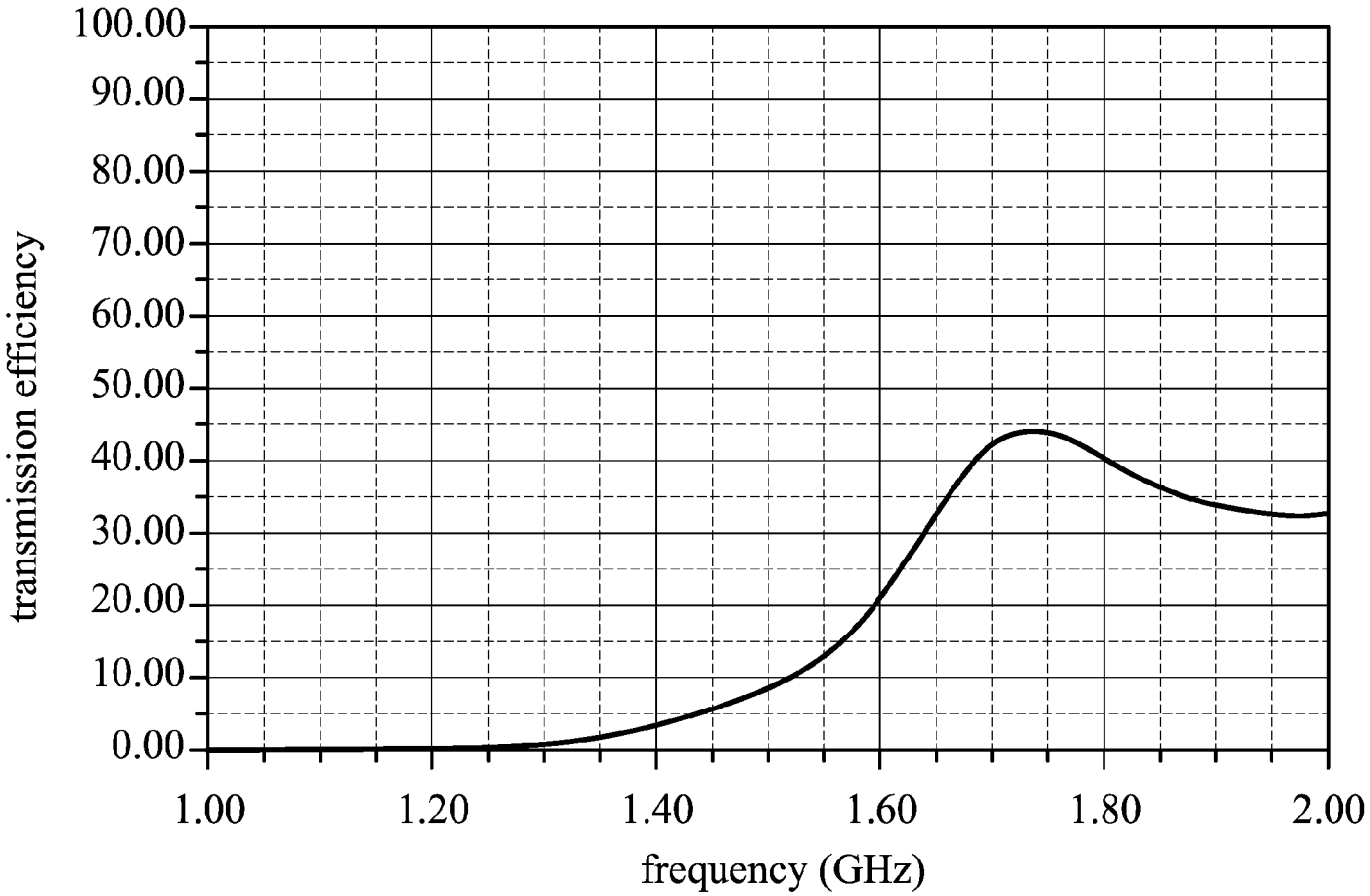
FIG. 3C shows transmission efficiency of the antenna of FIG. 3A.

With reference to FIGS. 3A, 3B and 3C, FIG. 3A shows reference dimensions of the antenna 100 of an embodiment of the invention, wherein the unit of the dimension units is in millimeter. FIG. 3B shows Voltage Standing Wave Ratio (VSWR) of the antenna of FIG. 3A. FIG. 3C shows transmission efficiency of the antenna of FIG. 3A. As shown in FIGS. 3B and 3C, the antenna of the embodiment of the invention provides improved bandwidth and transmission efficiency.

Figure 4A:
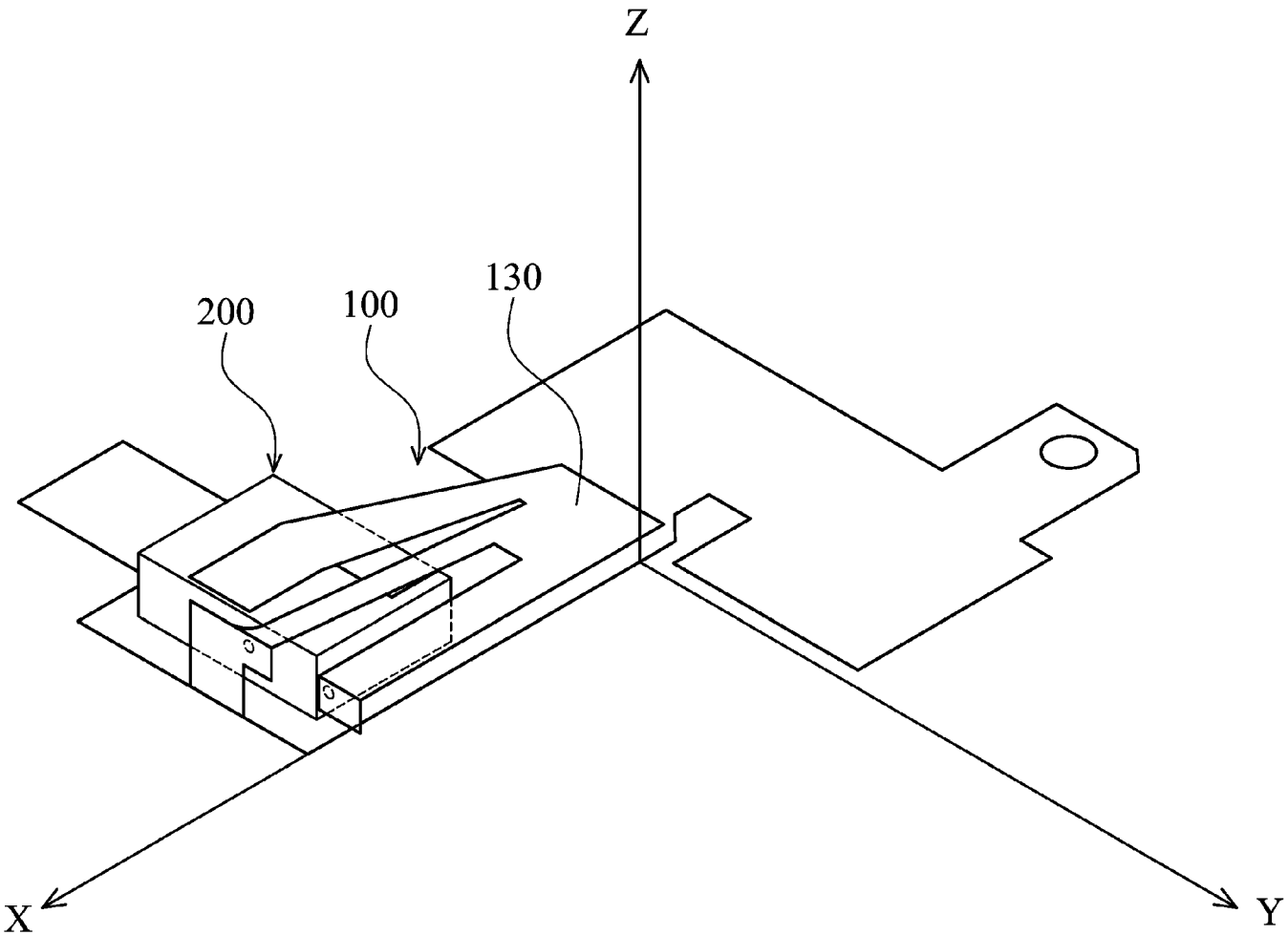
FIG. 4A shows a metal element disposed below a transmitting element of the embodiment of the invention.
Figure 4B:
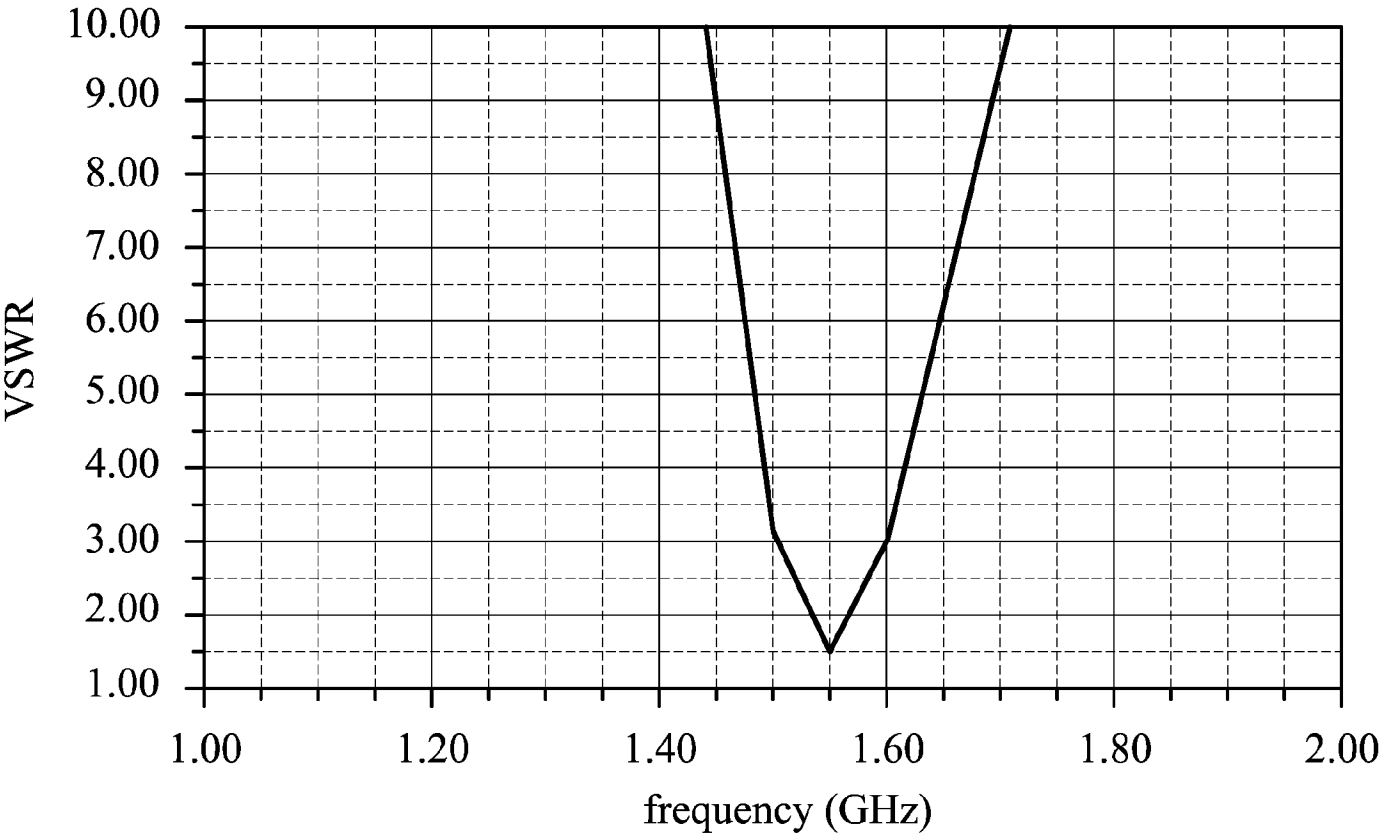
FIG. 4B shows Voltage Standing Wave Ratio (VSWR) of the antenna of FIG. 4A.
Figure 4C:
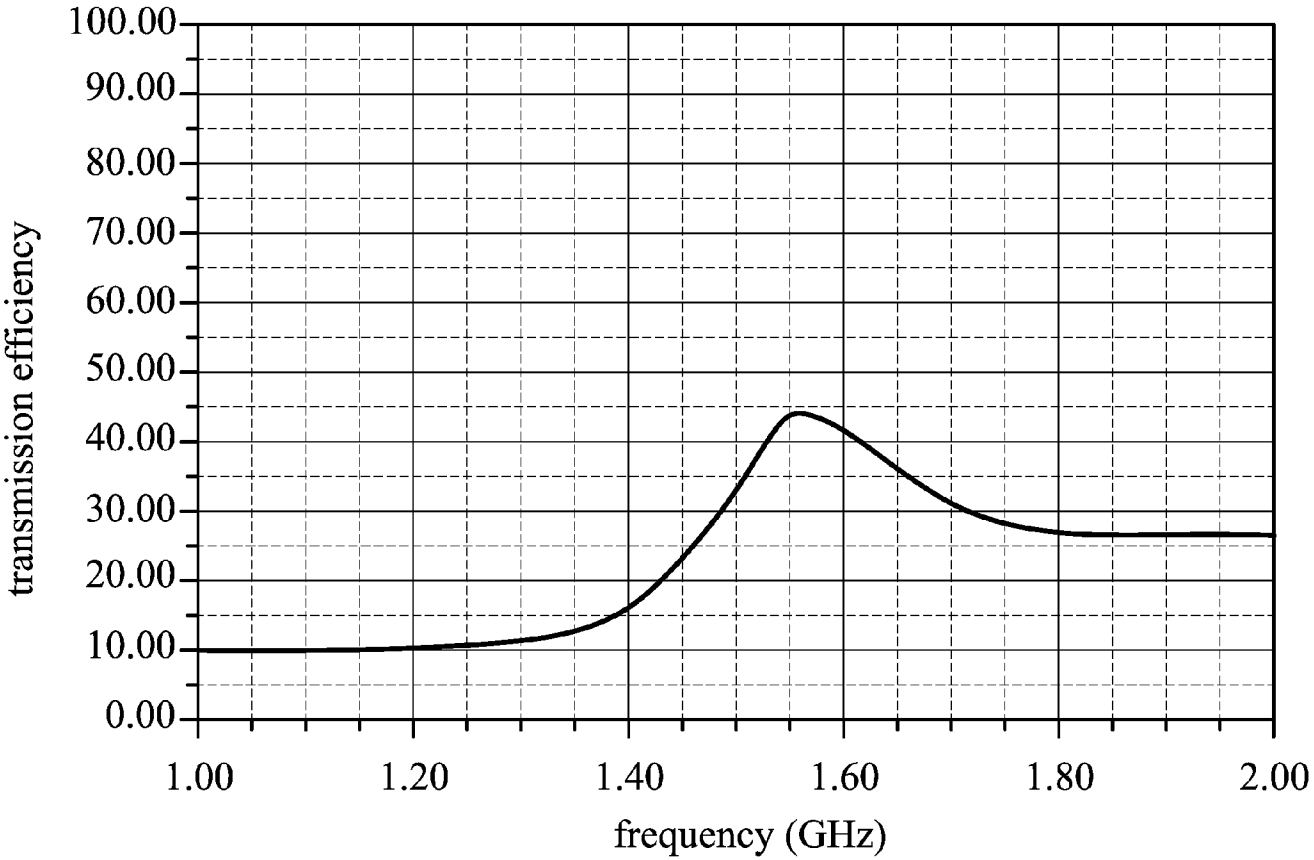
FIG. 4C shows transmission efficiency of the antenna of FIG. 4A.

With reference to FIGS. 4A, 4B and 4C, FIG. 4A shows a metal element 200 disposed below the transmitting element 130. FIG. 4B shows Voltage Standing Wave Ratio (VSWR) of the antenna of FIG. 4A. FIG. 4C shows transmission efficiency of the antenna of FIG. 4A. As shown in FIGS. 4B and 4C, the antenna of the embodiment of FIG. 4A still provides improved transmission efficiency even though a metal element is disposed below the transmitting element.

Figure 5:
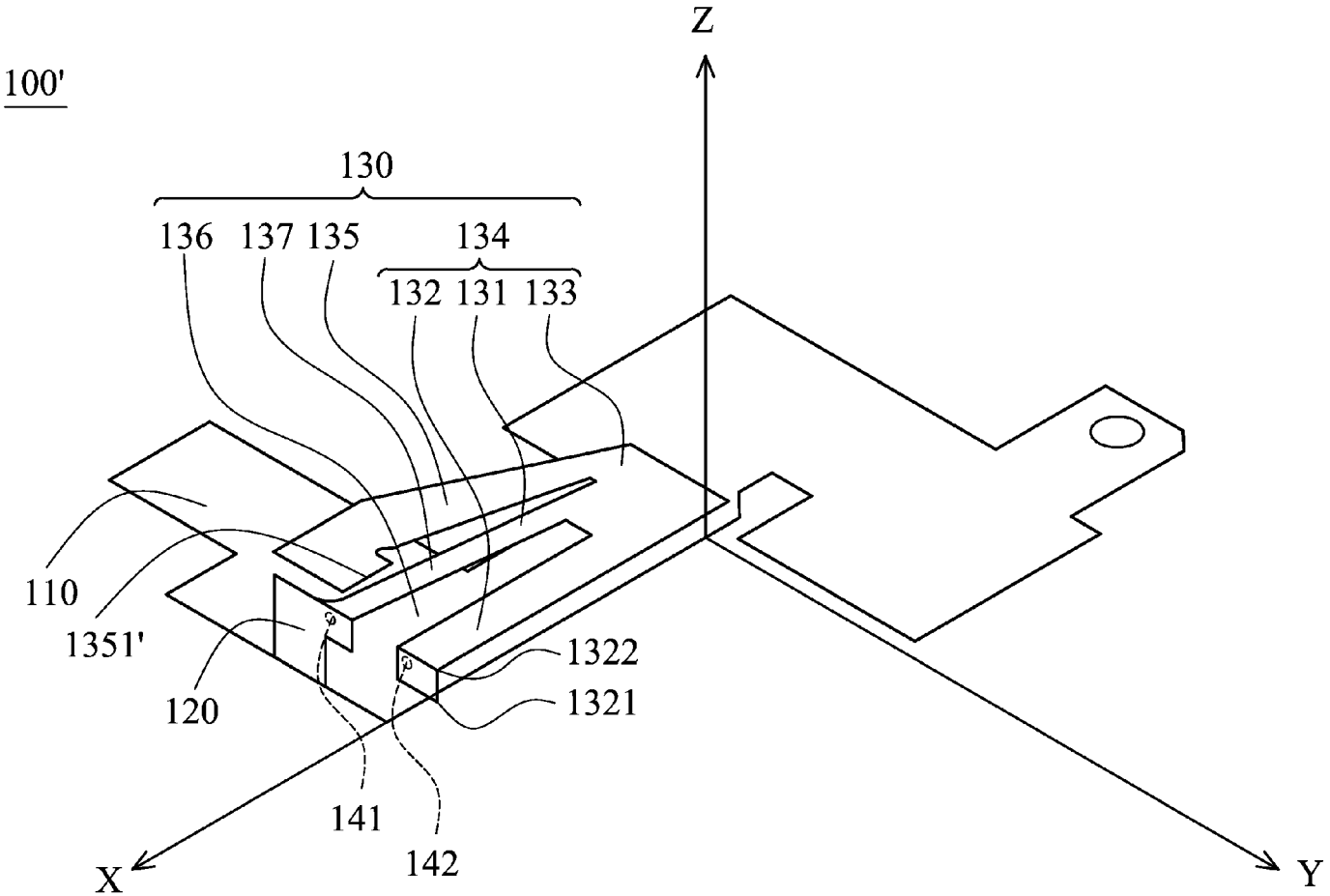
FIG. 5 shows an antenna of a modified example of the invention.

FIG. 5 shows an antenna 100' of a modified example of the invention, wherein the extending free end 1351' is curved to couple the first section 131 to improve transmission.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna for transmitting a wireless signal, comprising:

a ground element;

a short element, connected to the ground element;

a transmitting element, connected to the short element, wherein the transmitting element comprises a U shaped portion and an extending section, and the U shaped portion comprises a first section, a second section and a third section, wherein a first groove is formed between the first section and the second section, and a second end of the first section is connected to the short element, and a first end of the first section is connected to the third section, and a first end of the second section is connected to the third section, and a second end of the second section is a free end of the transmitting element, and a first end of the extending section is connected to the third section, and a second end of the extending section is an extending free end of the transmitting element, wherein a second groove is formed between the first section and the extending section;

a ground point, wherein the ground point is located on the short element; and a feed point, wherein the feed point is adjacent to the free end of the second section;

wherein the U shaped portion composes a loop antenna unit arranged such that a current travels from the ground point, passing the first section, the third section and the second section, along the first groove to the feed point, and wherein the first section and the extending section compose an open stub unit arranged such that the current travels from the ground point, passing the first section and the extending section, along the second groove to the extending free end.

2. The antenna as claimed in claim 1, wherein the ground point is adjacent to a connection point where the short element is connected to the transmitting element.

3. The antenna as claimed in claim 1, wherein the extending section extends toward the short element.

4. The antenna as claimed in claim 3, wherein a gap is formed between the extending free end of the extending section and the short element, and the extending free end of the extending section is coupled to the short element.

5. The antenna as claimed in claim 4, wherein the gap is between $0.03\lambda \sim 0.05\lambda$, and $\lambda$ is a wave length of a wireless signal.

6. The antenna as claimed in claim 1, wherein the ground element is located on a first plane, the transmitting element is located on a second plane, the first plane is parallel to the second plane, and a distance is formed between the first plane and the second plane.

7. The antenna as claimed in claim 6, wherein the short element is perpendicular to the ground element.

8. An antenna for transmitting a wireless signal, comprising:

a ground element;

a short element, connected to the ground element;

a transmitting element, connected to the short element, wherein the transmitting element is a three toe claw shaped structure comprising a first section, a second section and an extending section, wherein a second end of the first section is connected to the short element, and a first end of the first section is connected to first ends of the second section and the extending section, and a first groove is formed between the first section and the second section, and a second groove is formed between the first section and the extending section;

a ground point, wherein the ground point is located on the short element; and a feed point, wherein the feed point is adjacent to a second end of the second section;

wherein the first section and the second section composes a loop antenna unit arranged such that a current travels from the ground point, passing the first section and the second section, along the first groove to the feed point, and wherein the first section and the extending section compose an open stub unit arranged such that the current travels from the ground point, passing the first section and the extending section, along the second groove to a second end of the extending section.

9. The antenna as claimed in claim 8, wherein the ground point is adjacent to a connection point where the short element is connected to the transmitting element.

10. The antenna as claimed in claim 8, wherein the extending section extends toward the short element.

11. The antenna as claimed in claim 10, wherein a gap is formed between the second end the extending section and the short element, and the second end of the extending section is coupled to the short element.

12. The antenna as claimed in claim 11, wherein the gap is between 0.03λ~0.05λ, and λ is a wave length of a wireless signal.

13. The antenna as claimed in claim 8, wherein the ground element is located on a first plane, the transmitting element is located on a second plane, the first plane is parallel to the second plane, and a distance is formed between the first plane and the second plane.

14. The antenna as claimed in claim 13, wherein the short element is perpendicular to the ground element.

* * * * *